United States Patent [19]

Olson

[11] Patent Number: 4,545,517

[45] Date of Patent: Oct. 8, 1985

[54] CONTINUOUS FORMS LEADER

[76] Inventor: William J. Olson, R.R. #3, Glynwood Rd., Wapakoneta, Ohio 45895

[21] Appl. No.: 675,157

[22] Filed: Nov. 27, 1984

[51] Int. Cl.[4] ..... B65H 5/28; G03D 13/10

[52] U.S. Cl. ..... 226/92; 352/235; 414/20

[58] Field of Search ..... 226/91, 92, 96; 346/136; 352/235; 430/501; 414/14, 20

[56] References Cited

U.S. PATENT DOCUMENTS

| | | | |
|---|---|---|---|
| 1,500,393 | 7/1924 | Jones et al. | 430/501 |
| 1,992,751 | 2/1935 | Jensen | 226/92 |
| 2,438,063 | 3/1948 | Lorenz-Risler | 197/172 |
| 3,788,536 | 1/1974 | Brown | 226/91 |
| 4,110,774 | 8/1978 | Krehbiel et al. | 226/91 X |
| 4,330,191 | 5/1982 | Rawlings et al. | 226/92 X |

FOREIGN PATENT DOCUMENTS

| | | | |
|---|---|---|---|
| 912485 | 12/1962 | United Kingdom | 226/91 |

*Primary Examiner*—Leonard D. Christian
*Assistant Examiner*—Lloyd D. Doigan
*Attorney, Agent, or Firm*—Biebel, French & Nauman

[57] ABSTRACT

A forms leader is disclosed for use in printing of business forms by a printing device. The leader includes a rectangular sheet of flexible material having a series of line holes formed along the edges of the sheet. The sheet is folded along a crease to define a front portion of the sheet which is of less length than a rear portion. The crease is further positioned so that the line holes formed on the front portion align with those of the rear portion. An adhesive strip is formed across the front surface of the rear portion of the sheet, the strip being positioned along the surface so that at least a portion thereof is above a line corresponding to the bottom edge of the front portion. The adhesive has a relatively low tack, whereby the form can be removably secured to the adhesive with the front portion of the sheet extending over a portion of the form and the line holes of the form aligning with those of the sheet.

6 Claims, 3 Drawing Figures

CONTINUOUS FORMS LEADER

BACKGROUND OF THE INVENTION

The present invention relates generally to the printing of continuous forms by a computer-controlled printing device and, more particularly, to a leader for feeding a single form or the first of a series of forms into the printing device.

In recent years, computers have become an increasingly popular and useful tool for large and small business as well as for individuals. One common use for computers, utilizing the ability of a computer to drive a printing device, is the preparation of preprinted forms. Such forms are used for many documents, such as checks, invoices, purchase orders, other business records and the like.

Forms for such use are typically supplied in a continuous web with each individual form divided by perforations for separation of the forms after printing. The web is fed through a printing device, where large numbers of such forms can be printed in rapid succession, using information stored and supplied by the computer.

A typical arrangement for a printing device for printing forms is shown in FIG. 1. A web 10 comprises a series of successive forms, with the web 10 being provided with a series of equally spaced line holes 12 along each edge of the web. The positioning of such holes is in accordance with generally accepted industry standards, with the most common spacing between successive holes 12 being ½" (1.27 cm) center-to-center.

The printing device includes a print head 14 connected to an appropriate carriage structure 16 for lateral movement of print head 14 as indicated by arrow 18. The web 10 enters the device and passes around a roller 20 which directs the web beneath print head 14. A second roller 22 is provided with a series of pins 24 at each of its ends, the pins 24 being arranged so as to engage the line holes 12 of the web 10 as it passes around roller 22. (Such a pin and wheel arrangement is often referred to as a "tractor wheel".) Suitable hold-down rollers 26 or the like are also provided to keep the web 10 in engagement with roller 22 and pins 24.

Roller 22 is connected to a motor 28 for driving the roller in a direction indicated by arrow 30. This moves the web 10 through the printing device as indicated by arrow 32, so that the web is advanced with respect to print head 14 for printing of the web. In addition, roller 22 is connected to a hand-operated knob 34 which can be used to manually advance roller 22 for making adjustments in the positioning of web 10.

Of course, common concerns in the purchase, printing and subsequent use of forms include maximizing efficiency and economy. To a large extent, efficiency is enhanced by using a high-speed printing device. Increasing economy is approached by keeping waste of individual forms to an absolute minimum. This latter concern is important, since complex, multi-part forms can frequently cost as much as 20 cents or more per form.

One problem which can be seen from a review of FIG. 1 is that the web of forms 10 is driven by a roller 22 which is located further along the paper path of the printing device than print head 14. Consequently, in order to print the upper portion of a single form, it is necessary for the form to be preceded by some portion of the web. This is no problem where the particular form in question represents one of a series of forms to be printed, but where only a single form is to be prepared, or the form represents the first of a series of forms to be printed, it can be seen that there is no way for the upper portion of this form to be printed within the device.

The typical solution to this problem is to insert the web into the printing device and advance the web beyond the first form in the series. Of course, this wastes the first form, but there is little choice since printing upon this form is not possible. Not only does this represent an economic disadvantage, but also an efficiency disadvantage in that it can complicate bookkeeping procedures. Many forms, such as checks, invoices and the like, are prenumbered in sequence for bookkeeping purposes. Frequent waste of the first form of a series to be printed results in many numbers for which the form was ultimately discarded. Accounting for these unused numbers can be a great inconvenience.

What is needed, therefore, is a means by which waste of the first form of a series of preprinted forms can be avoided. Such a means would enable the upper portion of the initial form to be printed by the printing device, thereby rendering such a form usable. Of course, such a means must be relatively inexpensive, since it must cost less than the otherwise wasted forms to be economically practical.

SUMMARY OF THE INVENTION

In meeting the foregoing need, the present invention provides a forms leader for use in printing of business forms by a printing device having means for driving a form through the device. The driving means includes at least one tractor wheel having a plurality of drive pins carried thereon, the form being provided with a series of line holes spaced equidistantly along at least one edge of the form for engagement with the drive pins for driving of the form.

The forms leader includes a rectangular sheet of flexible material of a width equal to the width of the form. The sheet has formed therein a series of line holes along at least one edge thereof spaced equidistantly with a relatively spacing equal to the relative spacing between the line holes of the form. The sheet is folded along a crease formed in the sheet across its width. The crease is positioned to define a front portion of the sheet having a bottom edge and less length than a rear portion of the sheet. Both the front and rear portions are thus provided with a front surface. The crease is further positioned so that each of the line holes formed on the front portion aligns with one of the line holes formed on the rear portion.

An adhesive strip is formed across the front surface of the rear portion of the sheet. The strip extends along the surface so that at least a portion of the strip is above from a line defined on the rear portion corresponding to the bottom edge of the front portion. The adhesive is selected to have a relatively low tack, whereby the form may be removably secured to the adhesive with the front portion of the sheet extending over a portion of the form and the line holes of the sheet aligning with the line holes of the form. The form does not cover the entire strip, so that the strip also secures the front and rear portions together.

The forms leader may include indicia carried on the front surface of the rear portion of the sheet, the indicia being positioned above the line corresponding to the bottom edge of the front portion but along the adhesive strip. The indicia is positioned to indicate proper location for the top of the form for removable securing of the form to the adhesive strip. The strip may be at least partially transparent, so that the indicia can include a printed line extending at least partially across the front surface of the rear sheet portion under the adhesive strip.

The sheet may be formed from a heavy paper material.

Accordingly, it is an object of the present invention to provide a means for enabling the first of a series of continuous forms to be printed in a printing device; to provide such a means which comprises a forms leader that is removably attachable to the first of a series of continuous forms; to provide such a leader which is reusable; and to provide such a leader which can be inexpensively manufactured.

Other objects and advantages of the present invention will be apparent from the following description, the accompanying drawings, and the appended claims.

DETAILED DESCRIPTION OF THE PREFERRED EMBODIMENT

Figure 2:
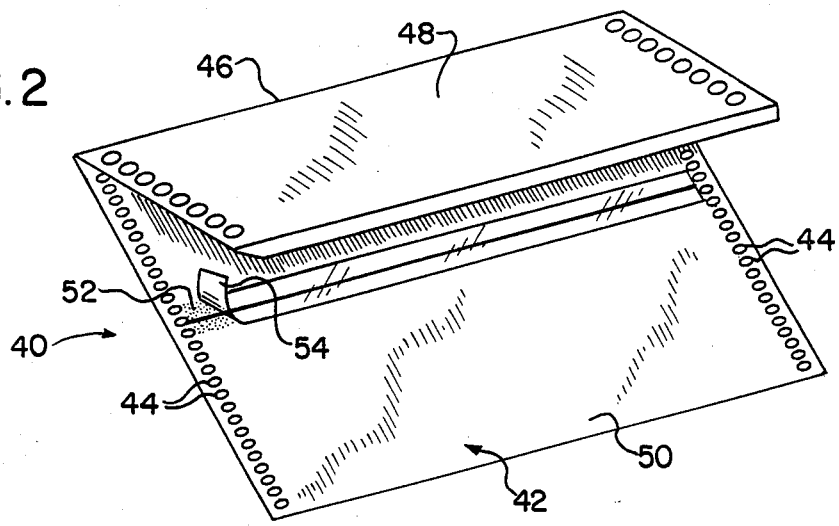
PRIOR ART FIG. 2
FIG. 2 is a perspective view showing the forms leader of the present invention.

Referring now to FIG. 2, a form leader 40 is fabricated from a sheet 42 of flexible material. Sheet 42 is preferably a heavy paper or light cardboard material, thereby resulting in a leader 40 which can be produced at low cost. However, sheet 42 may also be of a flexible plastic or other appropriate material.

Sheet 42 is of a width that is equal to the width of forms with which it is to be used, and includes a plurality of line holes 44 extending down each side of sheet 42. Holes 44 are separated by a standard spacing, so that they may be engaged with a standard tractor wheel such as roll 22 shown in FIG. 1. Holes 44 are formed having a diameter which is greater than is standard for such holes, but may be made using conventional die punch techniques.

A crease 46 is formed across sheet 42, perpendicular to the side edges of the sheet. The crease defines a front portion 48 and a rear portion 50 for leader 40, each portion 48 and 50 having a front surface. Crease 46 is located so that front portion 48 is of a shorter length than rear portion 50.

An adhesive strip 52 is positioned across the front surface of rear portion 50 of sheet 42. The adhesive is of a relatively low tack. Preferably, adhesive strip 52 is a separately formed acetate carrier strip having an adhesive on two sides, with the adhesive of one side being of a high tack and used to adhere the strip to rear portion 50. The opposite side of the carrier is coated with the low tack adhesive. Any appropriate two-sided tape may be used, but is preferably a commercially available tape manufactured by 3M Corp. of St. Paul, Minn., sold as No. Y9415, "High-Tack/Low-Tack Double-Coated Tape". Alternatively, the adhesive may be applied directly to the rear portion 50 by spraying. An appropriate paper strip 54 may be applied to adhesive strip 52 to protect the adhesive prior to use.

Figure 3:
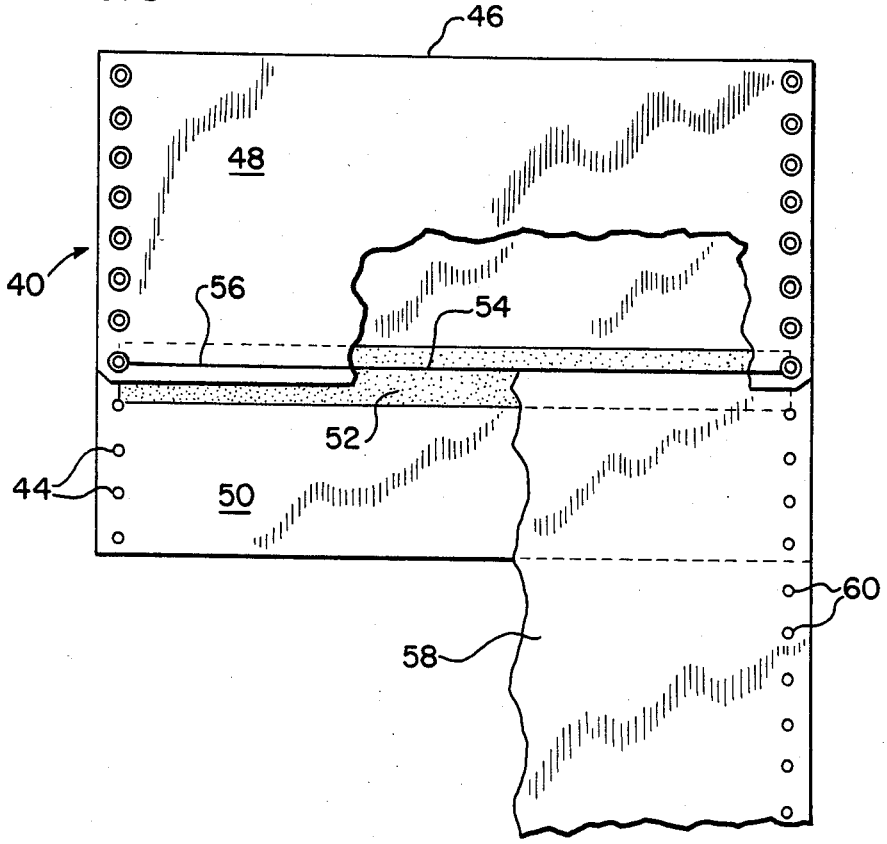
FIG. 3 is a plan view of the forms leader of FIG. 2, illustrating its use with a preprinted form.

Further detail with regard to leader 40 can be seen by reference to FIG. 3. In the preferred embodiment, adhesive strip 52 extends above and below a line on rear portion 50 that corresponds to the bottom edge of front portion 48, and is of a width of approximately 1" (2.5 cm). At a minimum, the adhesive strip 52 must occupy a portion of the front surface of rear portion 50 above the bottom edge of front portion 48. As an alternative in such a case, the adhesive strip can be applied to the rear surface of front portion 48.

The adhesive is at least partially transparent, and a printed line 54 is placed on rear portion 50 beneath the adhesive, located above the bottom edge of front portion 48. Some adhesive of strip 52, however, extends above printed line 54. A printed line 56 is provided in a location corresponding to line 54 on front portion 48 of the leader.

In using leader 40, the protective strip is removed from the adhesive. A form 58 to be printed is then placed onto adhesive strip 52 with its top edge positioned along printed line 54. Form 58 is pressed onto adhesive 52 to adhere it to the strip. (Since the adhesive used has a relatively low tack, form 58 may be subsequently removed.) Placement of form 58 along printed line 54 will cause line holes 60 of form 58 to align with line holes 44 of rear portion 50.

Front portion 48 is then folded over the top edge of form 58. Since strip 52 extends above printed line 54, front portion 48 is secured to rear portion 50 by the portion of the adhesive extending above form 58.

Figure 1:
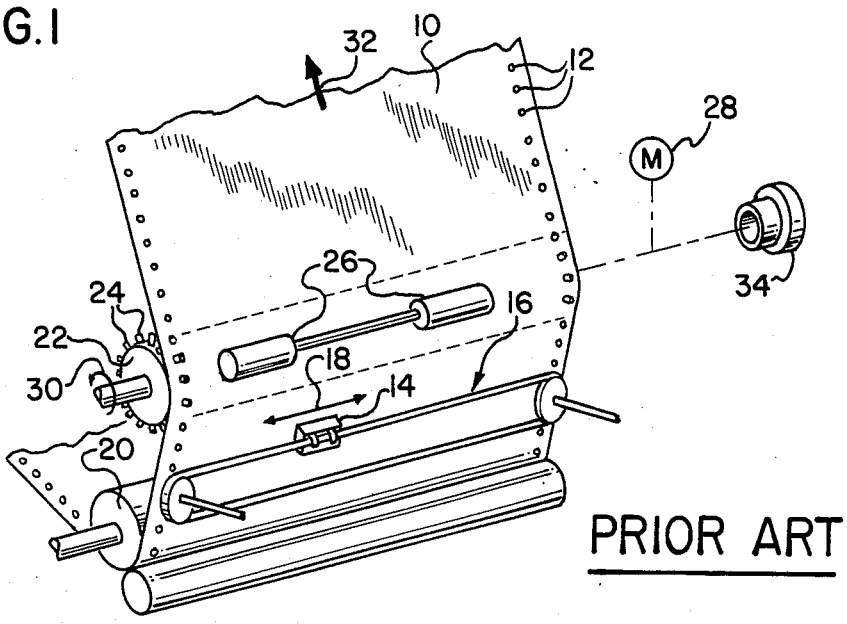
FIG. 1 is a perspective and partially schematic view of a typical feed arrangement for a printing device associated with a computer.

Leader 40 and the attached form 58 or web of forms is then fed into the printing device. Referring to FIG. 1 by way of example, leader 40 is threaded past roller 20 and print head 14. Line holes 44 along the edges of leader 40 are then engaged with pins 24 of roller 22. (At this point, it should be noted from FIG. 3 that the line holes formed along front portion 48 are of a diameter which is greater than that of the line holes formed along rear portion 50, which are also larger than standard size. This is done to avoid problems with alignment of the holes of the form and the folded-over portion of the leader during engagement with pins 24.)

After engagement of leader 40 with pins 24, knob 34 may be used to adjust form 58 to the proper position along the paper path through the printing device for printing of the form. Printed line 56, which will correspond with the top edge of form 58, may be referred to for this purpose. Once proper alignment has been made, printing of form 58 and of any following forms is performed in the normal manner.

Once form 58 has been removed from the printing device, leader 40 is simply peeled from form 58. Due to the low tack of adhesive 52, removal will not damage the form. Moreover, leader 40 can subsequently be reissued on other forms. When using the specific adhesive of the preferred embodiment, it has been found that a single leader 40 can be used approximately 30 times.

While the form of apparatus herein described constitutes a preferred embodiment of the invention, it is to be understood that the invention is not limited to this precise form of apparatus, and that changes may be made therein without departing from the scope of the invention.

What is claimed is:

1. A forms leader for use in printing of business forms by a printing device having means for driving a form through said device including at least one tractor wheel having a plurality of drive pins carried thereon, the form being provided with a series of line holes spaced equidistantly along at least one edge thereof for engagement with said drive pins for driving of the form, said leader comprising:

a rectangular sheet of flexible material of a width equal to the width of the form, said sheet having formed therein a series of line holes along at least one edge thereof spaced equidistantly with a relative spacing equal to the relative spacing between said line holes of the form;

said sheet being folded along a crease formed in said sheet across the width thereof, said crease being positioned to define a front portion of said sheet having a bottom edge and of less length than a rear portion of said sheet, said front and rear portions each having a front surface, said crease further being positioned so that each of said line holes formed on said front portion aligns with one of said line holes formed on said rear portion; and an adhesive strip formed across said front surface of said rear portion of said sheet, said strip extending along at least a portion of said surface above a line thereon corresponding to said bottom edge of said front portion;

said adhesive being selected to have a relatively low tack whereby the form may be removably secured to said adhesive with said front portion extending over a portion of the form and said line holes of said sheet aligning with the line holes of the form.

2. A forms leader as defined in claim 1, further comprising indicia carried on said front surface of said rear portion, said indicia being positioned above said line corresponding to said bottom edge of said front portion but along said adhesive strip, said indicia being positioned to indicate proper location for the top of the form for removably securing of the form to said adhesive strip.

3. A forms leader as defined in claim 2, wherein said adhesive strip is at least partially transparent, said indicia including a printed line extending at least partially across said front suface of said rear portion under said adhesive strip.

4. A forms leader as defined in claim 1, wherein said sheet is formed from a heavy paper material.

5. A forms leader as defined in claim 1, wherein said adhesive strip is formed from a tape having adhesive applied to both sides thereof, said tape being attached to said front surface of said rear portion of said sheet.

6. A forms leader for use in printing of business forms by a printing device having means for driving a form through said device including at least one tractor wheel having a plurality of drive pins carried thereon, the form being provided with a series of line holes spaced equidistantly along at least one edge thereof for engagement with said drive pins for driving of the form, said leader comprising:

a rectangular sheet of flexible material of a width equal to the width of the form, said sheet having formed therein a series of line holes along at least one edge thereof spaced equidistantly with a relative spacing equal to the relative spacing between said line holes of the form;

said sheet being folded along a crease formed in said sheet across the width thereof, said crease being positioned to define a front portion of said sheet having a bottom edge and of less length than a rear portion of said sheet, said front and rear portions each having a front and a rear surface, said crease further being positioned so that each of said line holes formed on said front portion aligns with one of said line holes formed on said rear portion; and an adhesive strip formed across said rear surface of said front portion of said sheet, said strip extending along at least a portion of said surface above said bottom edge thereof;

said adhesive being selected to have a relatively low tack whereby the form may be removably secured to said adhesive between said front portion and said rear portion with said line holes of said sheet aligning with the line holes of the form.

* * * * *